US009856607B2

(12) United States Patent
Hua et al.

(10) Patent No.: US 9,856,607 B2
(45) Date of Patent: Jan. 2, 2018

(54) CELLULOSE NANOFILAMENTS AND METHOD TO PRODUCE SAME

(75) Inventors: Xujun Hua, Kirkland (CA); Makhlouf Laleg, Pointe Claire (CA); Thomas Owston, Les Cèdres (CA)

(73) Assignee: FPINNOVATIONS, St-Jean, Pointe-Claire, QC (CA)

( * ) Notice: Subject to any disclaimer, the term of this patent is extended or adjusted under 35 U.S.C. 154(b) by 21 days.

(21) Appl. No.: 13/105,120

(22) Filed: May 11, 2011

(65) Prior Publication Data

US 2011/0277947 A1 Nov. 17, 2011

Related U.S. Application Data

(60) Provisional application No. 61/333,509, filed on May 11, 2010.

(51) Int. Cl.
*D21H 21/20* (2006.01)
*D21H 15/00* (2006.01)
(Continued)

(52) U.S. Cl.
CPC ..... *D21H 21/20* (2013.01); *D21B 1/342* (2013.01); *D21H 15/00* (2013.01); *D21H 17/67* (2013.01);
(Continued)

(58) Field of Classification Search
CPC ..... D21H 15/00; D21H 17/67; D21H 13/02; D21H 11/12; D21H 15/02; D21H 21/20;
(Continued)

(56) References Cited

U.S. PATENT DOCUMENTS 3,427,690 A * 2/1969 Haug ..... 19/66 R
4,036,679 A * 7/1977 Back et al. ..... 162/9
(Continued)

FOREIGN PATENT DOCUMENTS

CA 2437616 2/2005
CA 2666804 3/2008
(Continued)

OTHER PUBLICATIONS

Engineered Fibers Technology, LLC. Fibrillated Fibers, copyright 2010, p. 1.*
(Continued)

*Primary Examiner* — Scott R Walshon
(74) *Attorney, Agent, or Firm* — Norton Rose Fulbright Canada LLP

(57) ABSTRACT

Cellulose nanofilaments from cellulose fibers, a method and a device to produce them are disclosed. The nanofilaments are fine filaments with widths in the sub-micron range and lengths up to a couple of millimeters. These nanofilaments are made from natural fibers from wood and other plants. The surface of the nanofilaments can be modified to carry anionic, cationic, polar, hydrophobic or other functional groups. Addition of these nanofilaments to papermaking furnishes substantially improves the wet-web strength and dry sheet strength much better than existing natural and synthetic polymers. The cellulose nanofilaments produced by the present invention are excellent additives for reinforcement of paper and paperboard products and composite materials, and can be used to produce superabsorbent materials.

8 Claims, 6 Drawing Sheets

(51) Int. Cl.
*D21H 17/67* (2006.01)
*D21H 21/10* (2006.01)
*D21H 21/18* (2006.01)
*D21B 1/34* (2006.01)

(52) U.S. Cl.
CPC ..... *D21H 21/10* (2013.01); *D21H 21/18* (2013.01); *Y10T 428/298* (2015.01)

(58) Field of Classification Search
CPC ..... D21H 17/63; D21H 15/06; D21H 21/10; D21H 21/18; D21H 11/18; D21H 11/20; D21B 1/342; D21B 1/04–1/30; D21D 1/28; D21D 1/00; D21J 1/00; D21C 9/08; D21C 9/005; D21C 9/004; D21C 9/002; D21C 9/001; D21C 9/007; A61F 13/15; A24B 15/16; A24B 15/165; D01F 2/06; D01F 2/08; D01F 2/00; D01F 2/28; D01F 2/02; D01F 2/24; D21F 11/00; D02G 3/00; Y10S 264/27; Y10S 111/905; Y10S 111/90; Y10S 47/11; Y10S 47/09; Y10S 111/917; Y10S 514/844; Y10S 514/847; Y10S 514/845; Y10S 514/848; D06M 10/00; D06M 3/388; D06M 15/03; D06M 16/00; D06M 15/05; B01D 39/18; B01D 2239/025; B60C 9/00; C08B 15/00; C08B 1/08; C08B 1/00; C08B 15/04; C08B 37/0024; C08B 37/003; C08L 21/00; C08L 1/10; C08L 1/04; C08L 5/08; D01D 5/0007; D01D 1/02; A01C 7/06; A01M 9/00; A01M 7/0089; A01M 9/0092; A61K 8/027; A61K 8/64; A61K 8/645; A61K 8/65; A61K 8/731; A61K 8/736; A61K 8/8111; A61K 8/8123; A61K 8/8129; A61K 8/817; A61K 8/85; A61K 8/87; A61K 8/88; A61K 8/892; A61K 8/895; A61K 8/898; A61K 8/25; A61Q 19/00; A61Q 1/02; A61Q 1/08; A61Q 1/10; A61Q 1/14; A61Q 3/00; A61Q 5/00; A61Q 5/02; A61Q 13/00; A61Q 15/00; A61Q 17/04; A61Q 19/10; D04H 13/00; Y10T 428/298
USPC ..... 162/28, 149, 261, 181.1, 23, 181.2, 182, 162/183, 401; 977/762; 428/364, 297, 428/401, 292.1, 154, 375, 443; 514/57, 514/154, 171, 28, 440, 558; 264/211.14, 264/211.17, 211.12, 465; 424/401, 423, 424/70.28; 156/244.17
See application file for complete search history.

(56) References Cited

U.S. PATENT DOCUMENTS

| | | | | |
|---|---|---|---|---|
| 4,120,747 | A * | 10/1978 | Sarge et al. | 162/117 |
| 4,374,702 | A | 2/1983 | Turbak et al. | |
| 4,455,237 | A * | 6/1984 | Kinsley | 210/767 |
| 5,269,470 | A * | 12/1993 | Ishikawa et al. | 241/21 |
| 5,385,640 | A | 1/1995 | Weibel et al. | |
| 6,183,596 | B1 | 2/2001 | Matsuda et al. | |
| 6,336,602 | B1 | 1/2002 | Miles | |
| 6,420,013 | B1 * | 7/2002 | Vinson et al. | 428/154 |
| 6,514,384 | B1 * | 2/2003 | Jewell et al. | 162/181.1 |
| 6,818,101 | B2 | 11/2004 | Vinson et al. | |
| 6,835,311 | B2 | 12/2004 | Koslow | |
| 6,913,154 | B2 | 7/2005 | Koslow | |
| 7,240,863 | B2 | 7/2007 | Ettaleb et al. | |
| 7,297,228 | B2 | 11/2007 | Anderson et al. | |
| 7,300,541 | B2 | 11/2007 | Sabourin | |
| 7,381,294 | B2 | 6/2008 | Suzuki et al. | |
| 7,455,901 | B2 * | 11/2008 | Yano et al. | 428/292.1 |
| 7,566,014 | B2 | 7/2009 | Koslow et al. | |
| 7,758,720 | B2 | 7/2010 | Sabourin | |
| 7,758,721 | B2 | 7/2010 | Sabourin | |
| 2002/0028222 | A1 * | 3/2002 | Afriat | 424/401 |
| 2003/0134120 | A1 * | 7/2003 | Kim et al. | 428/375 |
| 2004/0009141 | A1 * | 1/2004 | Koenig et al. | 424/70.28 |
| 2008/0057307 | A1 | 3/2008 | Koslow et al. | |
| 2008/0296808 | A1 * | 12/2008 | Joo et al. | 264/465 |
| 2009/0065164 | A1 | 3/2009 | Goto et al. | |
| 2009/0151880 | A1 | 6/2009 | Aichinger et al. | |
| 2009/0288789 | A1 | 11/2009 | Sabourin et al. | |
| 2009/0324680 | A1 * | 12/2009 | Reneker et al. | 424/423 |
| 2010/0018641 | A1 * | 1/2010 | Branham et al. | 156/244.17 |
| 2010/0065236 | A1 * | 3/2010 | Henriksson | D21C 9/002 162/174 |

FOREIGN PATENT DOCUMENTS

| | | | |
|---|---|---|---|
| CL | 39564 | | 11/1995 |
| CN | 101864606 | | 10/2010 |
| GB | 2296726 | | 7/1996 |
| JP | 2008266828 | | 11/2008 |
| RU | 2365693 | | 9/2007 |
| WO | WO 9916960 | A1 * | 4/1999 |
| WO | 2005035866 | | 4/2005 |
| WO | WO 2007091942 | A1 * | 8/2007 |

OTHER PUBLICATIONS

Sakai et al. Chitosan-Coating of Cellulosic Materials Using an Aqueous Chitosan-CO2 Solution, Polymer Journal, vol. 34, No. 3, pp. 144-148 (2002).*
Frenot et al. Polymer nanofibers assembled by electrospinning, Current Opinion in Colloid and Interface Science 8 (2003) 64-75.*
Switzer et al. Experimental Biochemistry, meq conversion, Macmillan, Apr. 21, 1999, Table 1-1 pp. 1-3.*
Science Clarified, Cellulose, http://www.scienceclarified.com/Ca-Ch/Cellulose.html.copyright 2015 Advameg, Inc. pp. 1-5.*
Wikipedia, Methyl Cellulose, https://en.wikipedia.org/wiki/Methyl_cellulose.html, copyright Jul. 29, 2015, pp. 1-6.*
Kojiro Uetani et al., Nanofibrillation of Wood Pulp Using a High-Speed Blender, Research Institute for Sustainable Humanosphere, Kyoto University, Uji 611-0011, Japan, pp. A to F.
Eero Sjöström et al., "Analytical Methods in Wood Chemistry, Pulping, and Papermaking", Chemical Composition of Wood and Pulps, pp. 15 and 16, Springer-Verlag Berlin Heidelberg 1999
R. R. Hedge et al., "Cotton Fibers", www.engr.utk.edu/mse/pages/Textiles/Cotton%20fibers.htm, Apr. 2004.
"Fibers, Regenerated Cellulose", Kirk-Othmer Encyclopedia of Chemical Technology, Fifth Edition, vol. 11, pp. 246 and 270.
EPO Machine English Language translation of JP 2008266828.

* cited by examiner

CELLULOSE NANOFILAMENTS AND METHOD TO PRODUCE SAME

CROSS REFERENCE TO RELATED APPLICATION

This application claims the benefit under USC §119(e) of U.S. Provisional Application Ser. No. 60/333,509, filed May 11, 2010.

FIELD OF THE INVENTION

This invention relates to cellulose nanofilaments, a method to produce the cellulose nanofilaments from natural fibers originated from wood and other plants pulps, the nanofibrillating device used to make the nanofilaments, and a method of increasing paper strength.

PRIOR ART

Process and functional additives are commonly used in the manufacture of paper, paperboard and tissue products to improve material retention, sheet strength, hydrophobicity and other functionalities. These additives are usually water-soluble or emulsive synthetic polymers or resins derived from petroleum, or modified natural products such as starches, guar gums, and cellulose derivatives such as carboxymethyl cellulose made from dissolving cellulose pulp. Although most of these additives can improve the strength of dry paper, they do not really improve the strength of never-dried wet sheet. Yet, high wet-web strength is essential for good paper machine runability. Another drawback of these additives is their sensitivity to the chemistry of the pulp furnish where they can be deactivated by high conductivity and high level of anionic dissolved and colloidal substances. To be effective the polymers must adsorb on the surfaces of fibers and fines and then retained in the web during its manufacture. However, since polymer adsorption is never 100%, a large portion of polymer will circulate in machine whitewater system where the polymer can be deactivated or lost in sewer water which adds a load to effluent treatment.

Bleached softwood kraft fibers are commonly used for strength development in the manufacture of paper, tissue and paperboard grades as a reinforcement component. However, to be effective they must be well refined prior to their blending with pulp furnishes and added at levels usually ranging from 10% to 40%, depending on grade. The refining introduces fibrillation to pulp fibers, and increases their bonding potential.

Turbak et al. disclosed in 1983 (U.S. Pat. No. 4,374,702) a finely divided cellulose, called microfibrillated cellulose (MFC), and a method to produce it. The microfibrillated cellulose is composed of shortened fibers attached with many fine fibrils. During microfibrillation, the lateral bonds between fibrils in a fiber wall is disrupted to result in partial detachment of the fibrils, or fiber branching as defined in U.S. Pat. Nos. 6,183,596, 6,214,163 and 7,381,294. In Turbak's process, the microfibrillated cellulose is generated by forcing cellulosic pulp repeatedly passing through small orifices of a homogenizer. This orifice generates high shear action and converts the pulp fibers to microfibrillated cellulose. The high fibrillation increases chemical accessibility and results in a high water retention value, which allows achieving a gel point at a low consistency. It was shown that MFC improved paper strength when used at a high dosage. For example, the burst strength of handsheets made from unbeaten kraft pulp was improved by 77% when the sheet contained about 20% microfibrillated cellulose. Length and aspect ratio of the microfibrillated fibers are not defined in the patent but the fibers were pre-cut before going through the homogenizer. Japanese patents (JP 58197400 and JP 62033360) also claimed that microfibrillated cellulose produced in a homogenizer improves paper tensile strength.

The MFC after drying had difficulty to redisperse in water. Okumura et al. and Fukui et al of Daicel Chemical developed two methods to enable redispersion of dried MFC without loss of its viscosity (JP 60044538, JP 60186548).

Matsuda et al. disclosed a super-microfibrillated cellulose which was produced by adding a grinding stage before a high-pressure homogenizer (U.S. Pat. Nos. 6,183,596 & 6,214,163). Same as in the previous disclosures, microfibrillation in Matsuda's process proceeds by branching fibers while the fiber shape is kept to form the microfibrillated cellulose. However, the super microfibrillated cellulose has a shorter fiber length (50-100 μm) and a higher water retention value compared to those disclosed previously. The aspect ratio of the super MFC is between 50-300. The super MFC was suggested for use in the production of coated papers and tinted papers.

MFC could also be produced by passing pulp ten times through a grinder without further homogenization (Tangigichi and Okamura, Fourth European Workshop on Lignocellulosics and Pulp, Italy, 1996). A strong film formed from the MFC was also reported by Tangigichi and Okamura [Polymer International 47(3): 291-294 (1998)]. Subramanian et al. [JPPS 34(3) 146-152 (2008)] used MFC made from a grinder as a principal furnish component to produce sheets containing over 50% filler.

Suzuki et al. disclosed a method to produce microfibrillated cellulose fiber which is also defined as branched cellulose fiber (U.S. Pat. No. 7,381,294 & WO 2004/009902). The method consists of treating pulp in a refiner at least ten times but preferably 30 to 90 times. The inventors claim that this is the first process which allows for continual production of MFC. The resulting MFC has a length shorter than 200 μm, a very high water retention value, over 10 mL/g, which causes it to form a gel at a consistency of about 4%. The preferred starting material of Suzuki's invention is short fibers of hardwood kraft pulp.

The suspension of MFC may be useful in a variety of products including foods (U.S. Pat. No. 4,341,807), cosmetics, pharmaceutics, paints, and drilling muds (U.S. Pat. No. 4,500,546). MFC could also be used as reinforcing filler in resin-molded products and other composites (WO 2008/010464, JP2008297364, JP2008266630, JP2008184492), or as a main component in molded products (U.S. Pat. No. 7,378,149).

The MFCs in the above mentioned disclosures are shortened cellulosic fibers with branches composed of fibrils, and are not individual fibrils. The objectives of microfibrillation are to increase fiber accessibility and water retention. Significant improvement in paper strength was achieved only by addition of a large quantity of MFC, for example, 20%.

Cash et al. disclosed a method to make derivatized MFC (U.S. Pat. No. 6,602,994), for example, microfibrillated carboxymethyl cellulose (CMC). The microfibrillated CMC improves paper strength in a way similar to the ordinary CMC.

Charkraborty et al. reported that a novel method to generate cellulose microfibrils which involves refining with PFI mill followed by cryocrushing in liquid nitrogen. The fibrils generated in this way had a diameter about 0.1-1 μm and an aspect ratio between 15-85 [Holzforschung 59(1): 102-107 (2005)].

Smaller cellulosic structures, microfibrils, or nanofibrils with a diameter about 2-4 nanometers are produced from non-wood plants containing only primary walls such as sugar beet pulp (Dianand et al. U.S. Pat. No. 5,964,983).

To be compatible with hydrophobic resins, hydrophobicity could be introduced on the surface of microfibrils (Ladouce et al. U.S. Pat. No. 6,703,497). Surface esterified microfibrils for composite materials are disclosed by Cavaille et al (U.S. Pat. No. 6,117,545). Redispersible microfibrils made from non-wood plants are disclosed by Cantiani et al. (U.S. Pat. No. 6,231,657).

To reduce energy and avoid clogging in the production of MFC with fluidizers or homogenizers, Lindstrom et al. proposed a pretreatment of wood pulp with refining and enzyme prior to a homogenization process (WO2007/091942, 6$^{th}$ International Paper and Coating Chemistry Symposium). The resulting MFC is smaller, with widths of 2-30 nm, and lengths from 100 nm to 1 μm. To distinguish it from the earlier MFC, the authors named it nanocellulose [Ankerfors and Lindstrom, 2007 PTS Pulp Technology Symposium], or nanofibrils [Ahola et al., Cellulose 15(2): 303-314 (2008)]. The nano-cellulose or nanofibrils had a very high water retention value, and behaved like a gel in water. To improve bonding capacity, the pulp was carboxy methylated before homogenization. A film made with 100% of such MFC had tensile strength seven times as high as some ordinary papers and twice that of some heavy duty papers [Henriksson et al., Biomacromolecules 9(6): 1579-1585 (2008); US 2010/0065236A1]. However, because of the small size of this MFC, the film had to be formed on a membrane. To retain in a sheet, without the membrane, these carboxy methylated nanofibrils, a cationic wet-strength agent was applied to pulp furnish before introducing the nanofibrils [Ahola et al., Cellulose 15(2): 303-314 (2008)]. Anionic nature of nanofibrils balances cationic charge brought by the wet-strength agent and improves the performance of the strength agents. A similar observation was reported with nano-fibrillated cellulose by Schlosser [IPW (9): 41-44 (2008)]. Used alone, the nano-fibrillated cellulose acts like fiber fines in the paper stock.

Nanofibers with a width of 3-4 nm were reported by Isogai et al [Biomacromolecules 8(8): 2485-2491 (2007)]. The nanofibers were generated by oxidizing bleached kraft pulps with 2,2,6,6-tetramethylpiperidine-1-oxyl radical (TEMPO) prior to homogenization. The film formed from the nanofibers is transparent and has also high tensile strength [Biomacromolecules 10(1): 162-165 (2009)]. The nanofibers can be used for reinforcement of composite materials (US Patent Application 2009/0264036 A1).

Even smaller cellulosic particles having unique optical properties, are disclosed by Revol et al. (U.S. Pat. No. 5,629,055). These microcrystalline celluloses (MCC), or nanocrystalline celluloses as renamed recently, are generated by acid hydrolysis of cellulosic pulp and have a size about 5 nm by 100 nm. There are other methods to produce MCC, for example, one disclosed by Nguyen et al in U.S. Pat. No. 7,497,924, which generate MCC containing higher levels of hemicellulose.

The above mentioned products, nanocellulose, microfibrils or nanofibrils, nanofibers, and microcrystalline cellulose or nanocrystalline cellulose, are relatively short particles. They are normally much shorter than 1 micrometer, although some may have a length up to a few micrometers. There are no data to indicate that these materials can be used alone as a strengthening agent to replace conventional strength agents for papermaking. In addition, with the current methods for producing microfibrils or nanofibrils, the pulp fibers have to be cut inevitably. As indicated by Cantiani et al. (U.S. Pat. No. 6,231,657), in the homogenization process, micro or nano-fibrils cannot simply be unraveled from wood fibers without being cut. Thus their length and aspect ratio is limited.

More recently, Koslow and Suthar (U.S. Pat. No. 7,566,014) disclosed a method to produce fibrillated fibers using open channel refining on low consistency pulps (i.e. 3.5% solids, by weight). They disclose open channel refining that preserves fiber length, while close channel refining, such as a disk refiner, shortens the fibers. In their subsequent patent application (US 2008/0057307), the same inventors further disclosed a method to produce nanofibrils with a diameter of 50-500 nm. The method consists of two steps: first using open channel refining to generate fibrillated fibers without shortening, followed by closed channel refining to liberate the individual fibrils. The claimed length of the liberated fibrils is said to be the same as the starting fibers (0.1-6 mm). We believe this is unlikely because closed channel refining inevitably shortens fibers and fibrils as indicated by the same inventors and by other disclosures (U.S. Pat. Nos. 6,231,657, 7,381,294). The inventors' close refining refers to commercial beater, disk refiner, and homogenizers. These devices have been used to generate microfibrillated cellulose and nanocellulose in other prior art mentioned earlier. None of these methods generate the detached nano-fibril with such high length (over 100 micrometers). Koslow et al. acknowledge in US 2008/0057307 that a closed channel refining leads to both fibrillation and reduction of fiber length, and generate a significant amount of fines (short fibers). Thus, the aspect ratio of these nanofibrils should be similar to those in the prior art and hence relatively low. Furthermore, the method of Koslow et al. is that the fibrillated fibers entering the second stage have a freeness of 50-0 ml CSF, while the resulting nanofibers still have a freeness of zero after the closed channel refining or homogenizing. A zero freeness indicates that the nanofibrils are much larger than the screen size of the freeness tester, and cannot pass through the screen holes, thus quickly forms a fibrous mat on the screen which prevents water to pass through the screen (the quantity of water passed is proportional to the freeness value). Because the screen size of a freeness tester has a diameter of 510 micrometers, it is obvious that the nanofibers should have a width much larger than 500 nm.

The closed channel refining has also been used to produce MFC-like cellulose material, called as microdenominated cellulose, or MDC (Weibel and Paul, UK Patent Application GB 2296726). The refining is done by multiple passages of cellulose fibers through a disk refiner running at a low to medium consistency, typically 10-40 passages. The resulting MDC has a very high freeness value (730-810 ml CSF) even though it is highly fibrillated because the size of MDC is small enough to pass through the screen of freeness tester. Like other MFC, the MDC has a very high surface area, and high water retention value. Another distinct characteristic of the MDC is its high settled volume, over 50% at 1% consistency after 24 hours settlement.

SUMMARY OF THE INVENTION

In accordance with one aspect of the present invention, there is provided cellulosic nanofilaments comprising: a length of at least 100 μm, and a width of about 30 to about 300 nm, wherein the nanofilaments are physically detached from each other, and are substantially free of fibrillated cellulose, wherein the nanofilaments have an apparent freeness value of over 700 ml according to Paptac Standard Testing Method C1, wherein a suspension comprising 1% w/w nanofilaments in water at 25° C. under a shear rate of 100 $s^{-1}$ has a viscosity greater than 100 cps.

In accordance with another aspect of the present invention, there is provided a method of producing cellulosic nanofilaments from a cellulose raw material pulp comprising the steps of: providing the pulp comprising cellulosic filaments having an original length of at least 100 μm; and feeding the pulp to at least one nanofilamentation step comprising peeling the cellulosic filaments of the pulp by exposing the filaments to a peeling agitator with a blade having an average linear speed of at least 1000 m/min to 2100 m/min, wherein the blade peels the cellulosic fibers apart while substantially maintaining the original length to produce the nanofilaments, wherein the nanofilaments are substantially free of fibrillated cellulose.

In accordance with yet another aspect of the present invention, there is provided a method of treating a paper product to improve strength properties of the paper product compared with non-treated paper product comprising: adding up to 50% by weight of cellulosic nanofilaments to the paper product, wherein the nanofilaments comprise, a length of at least 100 μm, and a width of about 30 to about 300 nm, wherein the nanofilaments are substantially free of fibrillated cellulose, wherein the nanofilaments have an apparent freeness value of over 700 ml according to Paptac Standard Testing Method C1, wherein a suspension comprising 1% w/w nanofilaments in water at 25° C. under a shear rate of 100 $s^{-1}$ has a viscosity greater than 100 cps, wherein the strength properties comprise at least one of wet web strength, dry paper strength and first-pass retention.

In accordance with still another aspect of the present invention, there is provided a cellulose nanofilamenter for producing cellulose nanofilament from a cellulose raw material, the nanofilamenter comprising: a vessel adapted for processing the cellulose raw material and comprising an inlet, and outlet, an inner surface wall, wherein the vessel defines a chamber having a cross-section of circular, square, triangular or polygonal shape; a rotating shaft operatively mounted within the chamber and having a direction of rotation, the shaft comprising a plurality of peeling agitators mounted on the shaft; the peeling agitators comprising: a central hub for attaching to a shaft rotating about an axis; a first set of blades attached to the central hub opposite each other and extending radially outward from the axis, the first set of blades having a first radius defined from the axis to an end of the first blade; a second set of blades attached to the central hub opposite each other and extending radially outward from the axis, the second set of blades having a second radius defined from the axis to an end of the second blade, wherein each blade has a knife edge moving in the direction of rotation of the shaft, and defining a gap between the inner surface wall and the tip of the first blade, wherein the gap is greater than the length of the nanofilament.

In accordance with another aspect of the invention, there is provided a mineral paper comprising at least 50% by weight of mineral filler and at least 1%, and up to 50% cellulose nanofilaments as defined above.

DESCRIPTION OF THE INVENTION

Figure 1A:
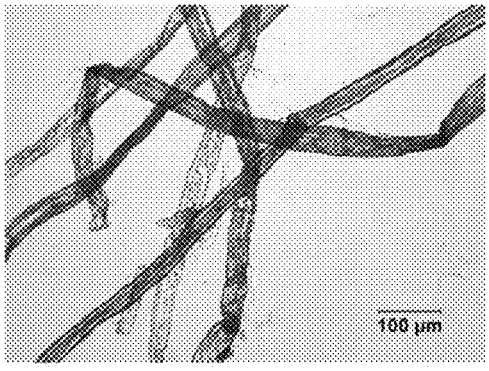
FIG. 1A is a micrograph of a softwood kraft fiber cellulose raw material according to one embodiment of the present invention, viewed through an optical microscope.

It is an objective of the present invention to provide a cellulosic material made from natural fibers, that is superior to all the cellulosic materials disclosed in the above mentioned prior art in terms of aspect ratio and the ability to increase the strength of paper, tissue, paperboard and plastic composite products. It is a further objective of this invention to provide a strengthening agent made from natural fibers whose performance is superior to existing commercial strengthening polymeric agents including starches and synthetic polymers or resins. It is another objective to provide a strength agent made from natural fibers that not only improves dry strength, but also the strength of the moist web before sheet drying. An additional objective of the invention is to provide fibrous reinforcing materials for the composite manufacture. Yet another objective of the invention is to provide fibrous materials for superabsorbent products. Still another objective is to provide a method or a device and a process to produce the high-performance cellulosic material from natural fibers.

Accordingly, we have discovered that cellulose nanofilaments produced from natural fibers using our method have performance superior to conventional strength polymers and are different from all the cellulosic materials disclosed in prior art. Our nanofilaments are neither cellulosic fibril bundles nor fibers branched with fibrils or separated short fibrils. The cellulose nanofilaments are individual fine threads unraveled or peeled from natural fibers and are much longer than nanofibres, micro fibrils, or nano-celluloses as disclosed in the prior art. These cellulose filaments have a length preferably from 100 to 500 micrometers; typically 300 micrometers; or greater than 500 micrometers, and up to a couple of millimeters, yet have a very narrow width, about 30-300 nanometers, thus possess an extremely high aspect ratio.

Because of their high aspect ratio, the cellulose nanofilaments form a gel-like network in aqueous suspension at a very low consistency. The stability of the network can be determined by the settlement test described by Weibel and Paul (UK Patent Application GB 2296726). In the test, a well dispersed sample with a known consistency is left to settle by gravity in a graduated cylinder. A settled volume after a given time is determined by the level of the interface between settled cellulose network and supernatant liquid above. The settled volume is expressed as the percentage of the cellulose volume after settling to the total volume. The MFC disclosed by Weibel et al. has a settled volume greater than 50% (v/v) after 24 hours settlement at an initial consistency of 1% (w/w). By contrast, the CNF made according to this invention never settles at 1% consistency in aqueous suspension. CNF suspension practically never settles when its consistency is over 0.1% (w/w). The consistency resulting in a settled volume of 50% (v/v) after 24 hours is below 0.025% (w/w), one order of magnitude lower than that of MDC or MFC disclosed by Weibel et al. Therefore, the CNF of the present invention is significantly different from the MFC or MDC disclosed earlier.

CNF also exhibits a very high shear viscosity. At a shear rate of 100 $s^{-1}$, the viscosity of CNF is over 100 centipoises when measured at a consistency of 1% (w/w), and 25° C. The CNF is established according to Paptac Standard Testing Method C1.

Unlike the nanocelluloses made by chemical methods, the CNF of the present invention has a degree of polymerization of the nanofilaments (DP) very close to that of the source cellulose. For example, the $DP_{nanofilaments}$ of a CNF sample produced according to this invention was 1330, while the $DP_{initial}$ of the starting softwood kraft fibers was about 1710. The ratio of $DP_{nanofilaments}/DP_{initial}$ approaches 1 and is at least 0.60; more preferably at least 0.75, and most preferably at least 0.80.

Because of its narrow width of the CNF, and shorter length relative to the original fibers, the CNF in an aqueous suspension can pass through the screen without forming a mat to obstruct water flow during freeness test. This enables CNF to have a very high freeness value, close to the carrier liquid, i.e. water itself. For example, a CNF sample was determined to have a freeness of 790 ml CSF. Because a freeness tester is designed for normal-size papermaking fibers to determine their fibrillation, this high freeness value, or apparent freeness, does not reflect the drainage behavior of the CNF, but an indication of its small size. The fact the CNF has a high freeness value whereas the freeness of the nanofibers of Koslow is near zero is a clear indication that the two families of products are different.

Figure 1B:
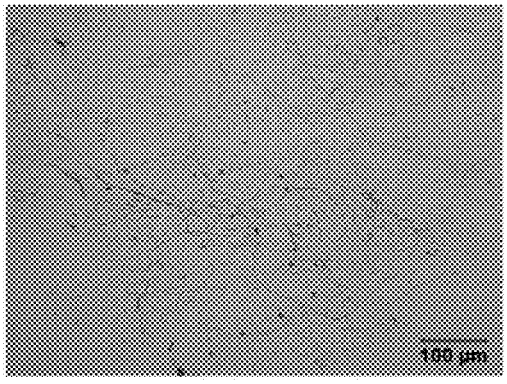
FIG. 1B is a micrograph of the cellulose nanofilaments produced from the raw material of FIG. 1A according to one embodiment of the present invention viewed through an optical microscope.
Figure 2:
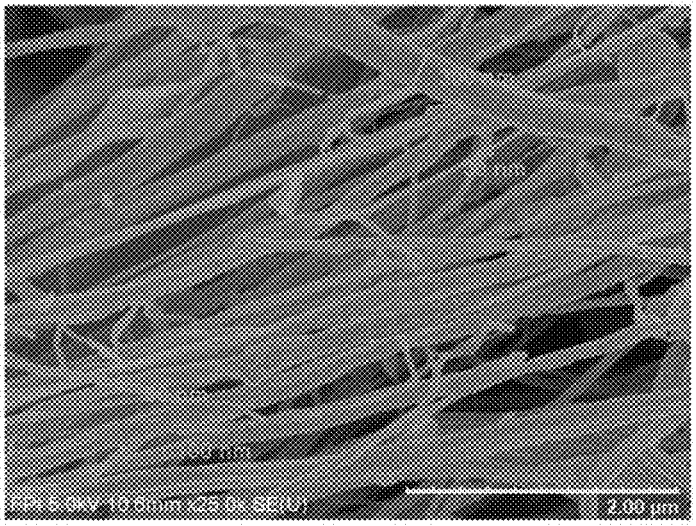
FIG. 2 is a micrograph of cellulose nanofilaments produced according to one embodiment of the present invention viewed through a scanning electronic microscope.

The surface of the nanofilaments could be rendered cationic or anionic, and may contain various function groups, or grafted macromolecules to have various degrees of hydrophilicity or hydrophobicity. These nanofilaments are extraordinarily efficient for improving both wet-web strength and dry paper strength, and functioning as reinforcement in composite materials. In addition, the nanofilaments improve significantly fines and filler retention during papermaking. FIGS. 1A and 1B show micrographs of starting raw material fibers and cellulose nanofilaments produced from these fibers according to the present invention, respectively. FIG. 2 is a micrograph of the nanofilaments at a higher magnification using a scanning electronic microscope. It should be understood that "microfibrillated cellulose" is defined as a cellulose having numerous strands of fine cellulose branching outward from one or a few points of a bundle in close proximity and the bundle has approximately the same width of the original fibers and typical fiber length in the range of 100 micrometers. "Substantially free" is defined herein an absence or very near absence of the microfibrillated cellulose.

The expression "the nanofilaments are physically detached from each other" means that the nanofilaments are individual threads that are not associated or attached to a bundle, i.e. they are not fibrillated. The nanofilaments may however be in contact with each other as a result of their respective proximity. For a better understanding, the nanofilaments may be represented as a random dispersion of individual nanofilaments as shown in FIG. 2.

We have also discovered that the nanofilaments according to the present invention may be used in the manufacture of mineral papers. The mineral paper according to an aspect of the invention comprises at least 50% by weight of mineral filler and at least 1% w/w, and up to 50% w/w cellulose nanofilaments as defined above. The term "mineral paper" means a paper that has as the main component, at least 50% by weight, a mineral filler, such as calcium carbonate, clay, and talc, or a mixture thereof. Preferably, the mineral paper has a mineral content up to 90% w/w with adequate physical strength. The mineral paper according to this invention is more environmentally friendly comparing to commercial mineral papers which contain about 20% by weight of petroleum-based synthetic binders. In the present application, a treated paper product comprises the cellulose nanofilaments produced herein while a non-treated paper product lacks these nanofilaments.

In addition, we have discovered that the said cellulosic nanofilaments can be produced by exposing an aqueous cellulose fiber suspension or pulp to a rotating agitator, including blade or blades have a sharp knife edge or a plurality of sharp knives edges rotating at high speeds. The edge of the knife blade can be a straight, or a curved, or in a helical shape. The average linear speed of the blade should be at least 1000 m/min and less than 1500 m/min. The size and number of blades influence the production capacity of nanofilaments.

Figure 3:
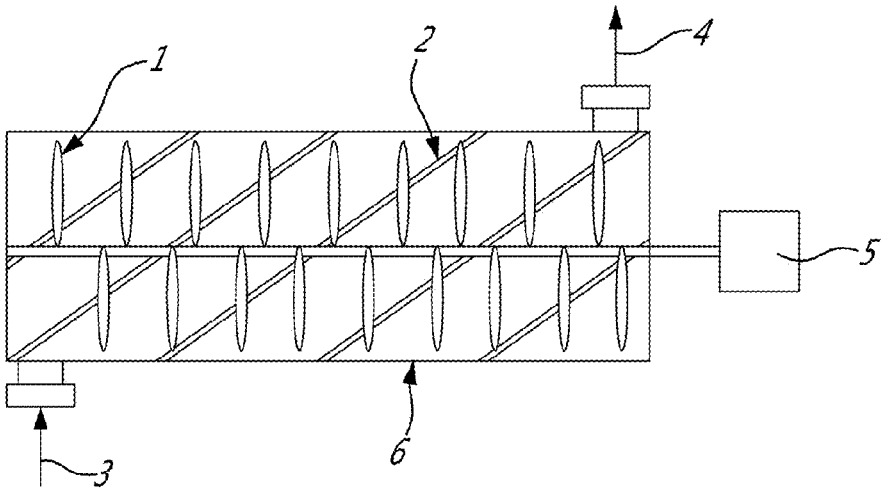
FIG. 3 is a schematic representation of a cellulose nanofilamentation device according to one embodiment of the present invention.

The preferred agitator knife materials are metals and alloys, such as high carbon steel. The inventors have discovered by surprise that contraintuitively, a high-speed sharp knife used according to the present invention does not cut the fibers but instead generates long filaments with very narrow widths by apparently peeling the fibers one from the other along the length of the fiber. Accordingly, we have developed a device and a process for the manufacture of the nanofilaments. FIG. 3 is a schematic presentation of such a device which can be used to produce the cellulosic nanofilaments. The nanofilamenting device includes 1: sharp blades on a rotating shaft, 2: baffles (optional), 3: pulp inlet, 4: pulp outlet, 5: motor, and 6: container having a cylindrical, triangular, rectangular or prismatic shape in cross-section along the axis of the shaft.

Figure 4:
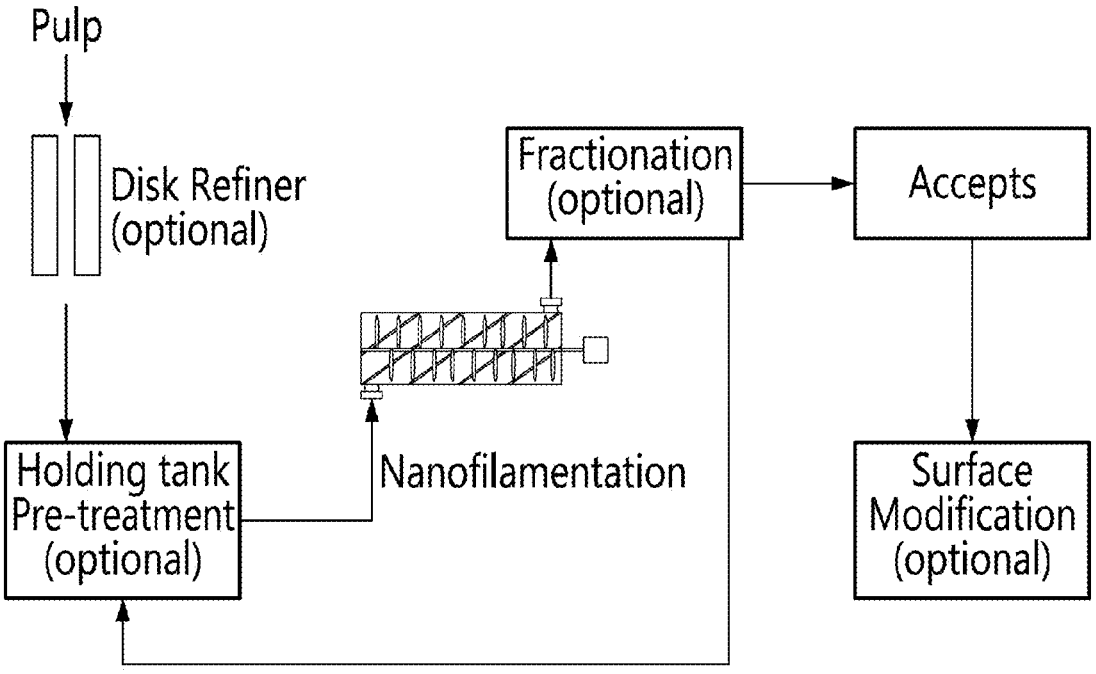
FIG. 4 is a block diagram for production of the cellulose nanofilaments according to one embodiment of the present invention.

FIG. 4 is a process block diagram where in a preferred embodiment the process is conducted on a continuous basis at a commercial scale. The process may also be batch or semi-continuous. In one embodiment of the process, an aqueous suspension of cellulose fibers is first passed through a refiner (optional) and then enters into holding or a storage tank. If desired, the refined fibers in a holding tank can be treated or impregnated with chemicals, such as a base, an acid, an enzyme, an ionic liquid, or a substitute to enhance the production of the nanofilaments. The pulp is then pumped into a nanofilamentation device. In one embodiment of the present invention several of nanofilamentation devices can be connected in series. After nanofilamentation, the pulp is separated by a fractionation device. The fractionation device could be a set of screens or hydro cyclones, or a combination of both. The fractionation device will separate the acceptable nanofilaments from the remaining pulp consisting of large filaments and fibers. The large filaments may comprise unfilamented fibers or filament bundles. The term unfilamented fibers means intact fibers identical to the refined fibers. The term filament bundles means fibers that are not completely separated and are still bonded together by either chemical bonds or hydrogen bond and their width is much greater than nanofilaments. The large filaments and fibers are recycled back to the storage tank or directly to the inlet of nanofilamentation device for further processing. Depending on the specific usage, the produced nanofilaments can bypass the fractionation device and be used directly. The nanofilaments generated may be further processed to have modified surfaces to carry certain function groups or grafted molecules. The surface chemical modification is carried out either by surface adsorption of functional chemicals, or by chemical bonding of functional chemicals, or by surface hydrophobation. The chemical substitution could be introduced by the existing methods known to those skilled in the art, or by proprietary methods such as those disclosed by Antal et al. in U.S. Pat. Nos. 6,455,661 and 7,431,799.

While it is not the intention to be bound by any particular theory regarding the present invention, it is believed that the superior performance of the nanofilaments is due to their relatively long length and their very fine width. The fine width enables a high flexibility and a greater bonding area per unit mass of the nanofilaments, while with their long length, allows one nanofilament to bridge and intertwine with many fibers and other components together. In the nanofilamentation device, there is much more space between agitator and a solid surface thus there can be greater fiber movement than in the homogenizers, disk refiners, or grinders used in the prior art. When a sharp blade strikes a fiber in the nanofilamentation device, it does not cut through the fiber because of the additional space, and lack of solid support to retain the fiber such as bars in a grinder or the small orifice in a homogenizer. The fiber is pushed away from the blade, but the high speed of the knife allows nanofilaments to be peeled off along the length of fiber and that without substantially reducing the original length. This in part explains the long length of the cellulose nanofilament obtained.

EXAMPLES

The following examples are presented to describe the present invention and to carry out the method for producing the said nanofilaments. These examples should be taken as illustrative and are not meant to limit the scope of the invention.

Example 1

Cellulose nanofilaments (CNF) were made from a mixture of bleached softwood kraft pulp and bleached hardwood kraft pulp according to the present invention. The proportion of softwood to hardwood in the blend was 25:75.

Figure 5:
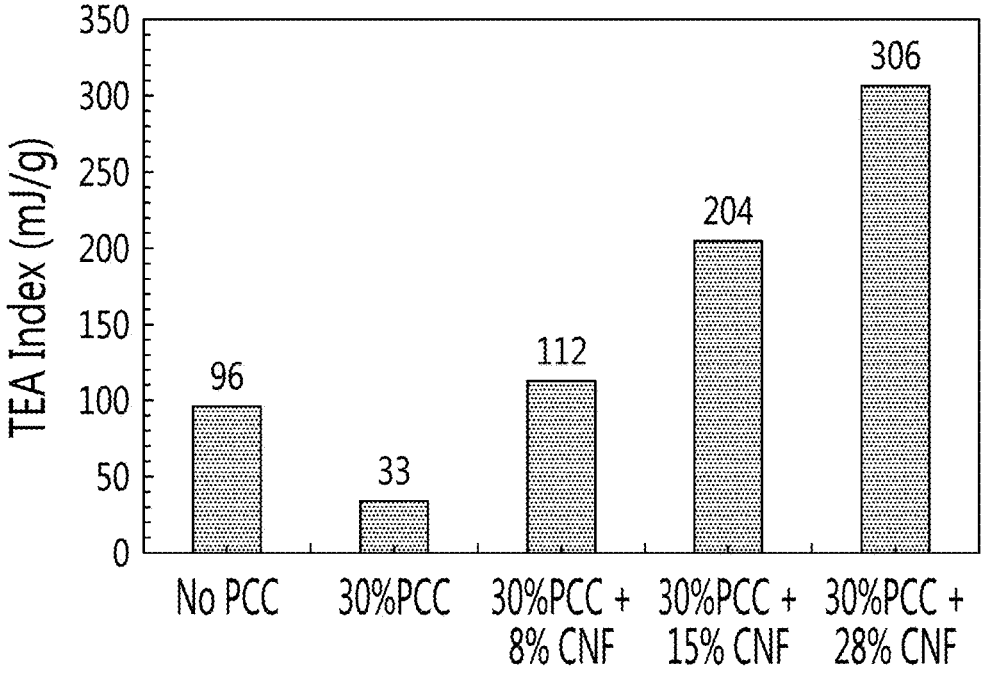
FIG. 5 is a bar chart of the tensile energy absorption of never-dried wet web at 50% (by dry weight) solids content including varying amounts of the cellulose nanofilaments according to one embodiment of the present invention in comparison with a prior art system.

The mixture was refined to a freeness of 230 ml CSF prior to the nanofilamentation procedure, liberate some fibrils on the surface of the feed cellulose. Eighty g/m$^2$ handsheets were made from a typical fine paper furnish with and without calcium carbonate filler (PCC), and with varying amounts of the nanofilaments. FIG. 5 shows the tensile energy absorption (TEA) of these never-dried wet sheets at 50% solids content. When 30% (w/w) PCC was incorporated into the sheets, the TEA index was reduced from 96 mJ/g (no filler) to 33 mJ/g. An addition of 8% CNF increased the TEA to a level similar to that of unfilled sheets. With higher levels of CNF addition, the wet-web strength was further improved, by 100% over the non-PCC standard. At a dosage level of 28%, the wet-web tensile strength was 9 times higher than the control sample with a 30% w/w PCC. This superior performance has never been claimed before with any commercial additives, or with any other cellulosic materials.

Example 2

Cellulose nanofilaments were prepared following the same method as in Example 1, except that unrefined bleached hardwood kraft pulp or unrefined bleached softwood kraft pulp were used instead of their mixture. A fine paper furnish was used to make handsheets with 30% w/w PCC. To demonstrate the effect of the two nanofilaments, they were added into the furnish at a dosage of 10% before sheet preparation. As shown in Table 1, 10% CNF from hardwood improved the wet-web TEA by 4 times. This is a very impressive performance. Nevertheless, the CNF from softwood had even a higher performance. The TEA of the web containing CNF from softwood was nearly seven times higher than that of the control sample. The lower performance of the CNF from hardwood compared to CNF from softwood is probably caused by it having shorter fibers. Hardwood usually has a significant amount of parenchyma cells and other short fibers or fines. CNF generated from short fibers may be shorter too, which reduced their performance. Thus, long fibers are a preferable starting material for CNF production, which is opposite to the MFC that prefers short fibers as disclosed by Suzuki et al (U.S. Pat. No. 7,381,294).

TABLE 1

Wet-web strength of the sheets containing 30% PCC and nanofilaments

| | Nanofilaments addition (w/w %) | TEA index at 50% solids |
|---|---|---|
| Control | 0 | 33 |
| CNF made from hardwood kraft | 10 | 139 |
| CNF made from softwood kraft | 10 | 217 |

Example 3

Figure 6:
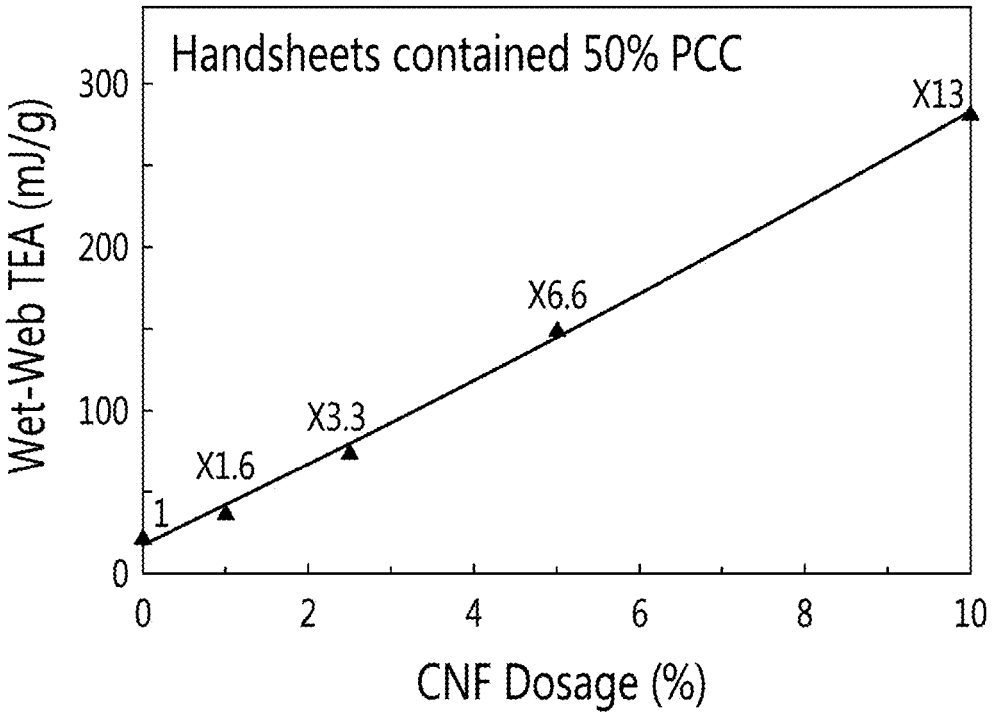
FIG. 6 is a graph of tensile energy absorption (TEA in mJ/g) of never-dried wet web versus dosage of cellulose nanofilaments (dry weight %) according to one embodiment of the present invention.

Cellulose nanofilaments were produced from 100% bleached softwood kraft pulp. The nanofilaments were further processed to enable the surface adsorption of a cationic chitosan. The total adsorption of chitosan was close to 10% w/w based on CNF mass. The surface of CNF treated in this way carried cationic charges and primary amino groups and had surface charge of at least 60 meq/kg. The surface-modified CNF was then mixed into a fine paper furnish at varying amounts. Handsheets containing 50% PCC on a dry weight basis were prepared with the furnish mixture. FIG. 6 shows the TEA index of the wet-web at 50% w/w solids as a function of CNF dosage. Once again, the CNF exhibits extraordinary performance in wet-web strength enhancement. There is an increase in TEA of over 60% at a dosage as low as 1%. The TEA increased linearly with CNF dosage. At an addition level of 10%, the TEA was 13 times higher than the control.

Example 4

Figure 7:
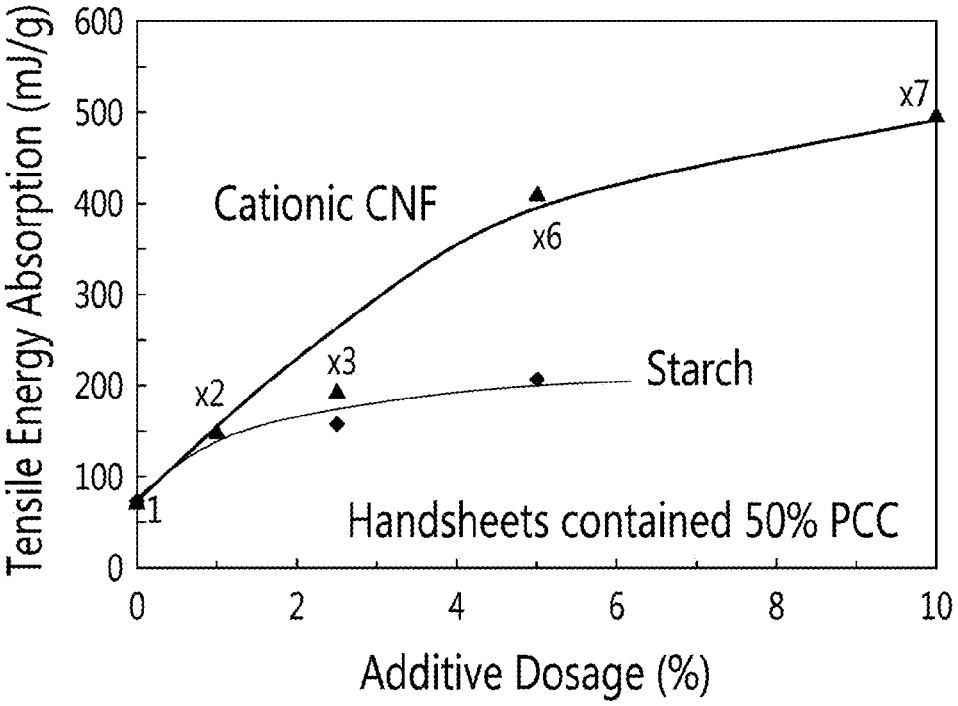
FIG. 7 is a graph of tensile energy absorption (TEA in mJ/g) of a dry sheet including cellulose nanofilaments according to one embodiment of the invention in comparison with a prior art system.

Cationic CNF was produced by following the same method as in Example 3. The CNF was then mixed into a fine paper furnish at varying amounts. Handsheets containing 50% w/w PCC were prepared with the furnish mixture following PAPTAC standard method C4. For comparison, a commercial cationic starch was used instead of CNF. The dry tensile strength of these handsheets is shown in FIG. 7 as a function of additive dosage. Clearly, the CNF is much superior to the cationic starch. At a dosage level of 5% (w/w), the CNF improved dry tensile of the sheets by 6 times, more than double the performance yielded by the starch.

Example 5

Cellulose nanofilaments were produced from a bleached softwood kraft pulp following the same procedure as in Example 2. Handsheets containing 0.8% nanofilaments and 30% PCC were prepared. For comparison, some strength agents including a wet-strength and a dry-strength resin, a cationic starch were used instead of the nanofilaments. Their wet-web strength at 50% w/w solids content is shown in Table 2. The nanofilaments improved TEA index by 70%. However, all other strength agents failed in strengthening the wet-web. Our further study showed that the cationic starch even reduced wet-web strength when PCC content in the web was below 20%.

TABLE 2

Tensile strength of wet-webs containing nanofilaments and conventional strength agents

| Additive | Dosage (%) | TEA index (mJ/g) |
|---|---|---|
| Control | 0 | 33 |
| CNF | 0.8 | 57 |
| Wet strength resin | 0.8 | 31 |
| Dry strength resin | 0.8 | 32 |
| Cationic Starch | 2 | 33 |

Example 6

Figure 8:
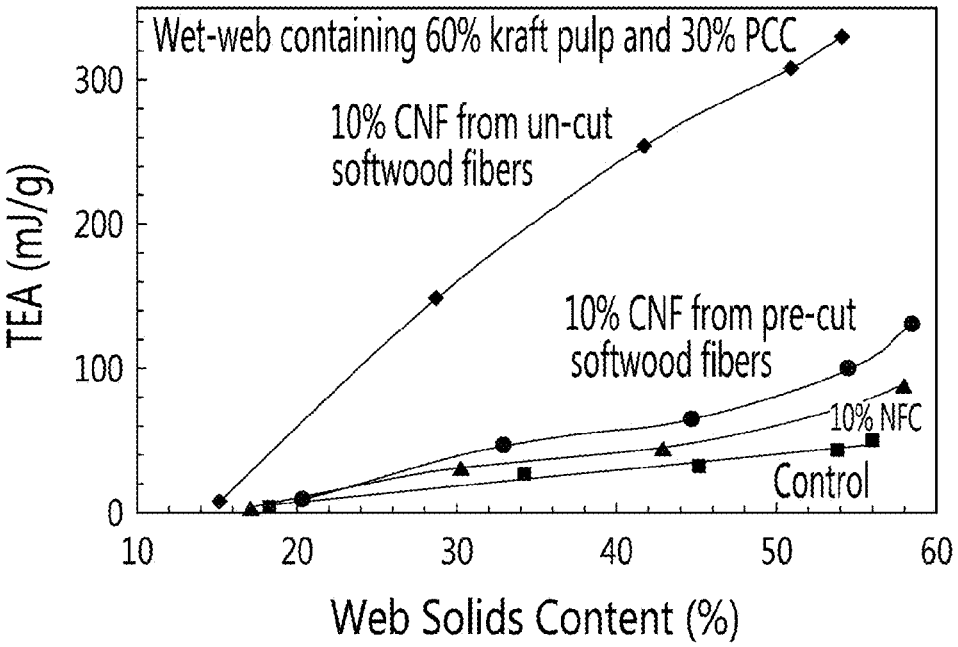
FIG. 8 is a graphic plot of tensile energy absorption (TEA in mJ/g) of wet-web containing 30% PCC as a function of web solids versus cationic CNF (dry weight %) according to another embodiment of the present invention in comparison with a prior art.

Cellulose nanofilaments were produced from a bleached softwood kraft pulp following the same procedure as in Example 2, except that the softwood fibers were pre-cut to a length of less than 0.5 mm before nanofilamentation. The CNF was then added to a fine paper furnish to produce handsheets containing 10% w/w CNF and 30% w/w PCC. For comparison, nanofilaments were also produced from the uncut softwood kraft fibers. FIG. 8 shows their wet-web tensile strength as a function of web-solids. Clearly, the pre-cutting reduces significantly the performance of CNF made thereafter. On the contrary, pre-cutting is preferable for the production of MFC (U.S. Pat. No. 4,374,702). This illustrates that the nanofilaments produced according to the present invention are very different from the MFC disclosed previously.

To further illustrate the difference between the cellulosic materials disclosed in prior art and the nanofilaments according to the present invention, handsheets were made with the same furnish as described above but with 10% of a commercial nanofibrillated cellulose (NFC). Their wet-web strength is also shown in FIG. 8. The performance of NFC is clearly much poorer than that of nanofilaments, even worse than the CNF from precut fibers according to the present invention.

Example 7

Cellulose nanofilaments were produced from a bleached softwood kraft pulp following the same procedure as in Example 2. The nanofilaments have extraordinary bonding potential for mineral pigments. This high bonding capacity allows forming sheets with extremely high mineral filler content without addition of any bonding agents like polymer resins. Table 3 shows the tensile strength of handsheets containing 80 and 90% w/w precipitated calcium carbonate or clay bonded with CNF. The strength properties of a commercial copy paper are also listed for comparison. Clearly CNF strengthens well the high mineral content sheets. The CNF-reinforced sheets containing 80% w/w PCC had tensile energy absorption index over 300 mJ/g, only 30% less than that of the commercial paper. To the knowledge of the inventors, these sheets are first in the world containing up to 90% w/w mineral filler reinforced only with natural cellulosic materials.

TABLE 3

Tensile strength of mineral sheets reinforced with nanofilaments

| Mineral type | Mineral content (%) | Nano-filaments (%) | Long fibre (%) | Breaking length (km) | Tensile energy absorption (mJ/g) |
|---|---|---|---|---|---|
| PCC | 80 | 6 | 14 | 1.25 | 315 |
| PCC | 90 | 4 | 6 | 0.56 | 134 |
| Clay | 90 | 4 | 6 | 0.99 | 230 |
| Commercial copy paper | 17 | 0 | 83 | 3.65 | 436 |

Example 8

Cellulose nanocomposites with various matrices were produced by casting in the presence and absence of nanofilaments. As illustrated in Table 4, nanofilaments improved significantly tensile index and elastic modulus of the composite films made with styrene-butadiene copolymer latex and carboxymethyl cellulose.

TABLE 4

Tensile strength of nanocomposite reinforced with nanofilaments

| Matrix | CNF (%) | Tensile index (N · m/g) | Elastic modulus (km) |
|---|---|---|---|
| Styrene-butadiene copolymer | 0 | 2.06 | 3.0 |
| Styrene-butadiene copolymer | 7.5 | 7.26 | 50 |

TABLE 4-continued

Tensile strength of nanocomposite reinforced with nanofilaments

| Matrix | CNF (%) | Tensile index (N · m/g) | Elastic modulus (km) |
|---|---|---|---|
| Carboxy methyl cellulose | 0 | 49.7 | 521 |
| Carboxy methyl cellulose | 7.5 | 63.5 | 685 |

Example 9

Cellulose nanofilaments were produced from a bleached softwood kraft pulp following the same procedure as in Example 2. These nanofilaments were added into a PCC slurry, before mixed with a commercial fine paper furnish (80% bleached hardwood/20% bleached softwood kraft) w/w. A cationic starch was then added to the mixture. First-pass retention (FPR) and first-pass ash retention (FPAR) were determined with a dynamic drainage jar under the following conditions: 750 rpm, 0.5% consistency, 50° C. For comparison, retention test was also conducted with a commercial retention aid system: a microparticle system which consisted of 0.5 kg/t of cationic polyacrylamide, 0.3 kg/t of silica, and 0.3 kg/t of anionic micropolymer.

As shown in Table 5, without retention aids and CNF, the FPAR was only 18%. The microparticle improved the FPAR to 53%. In comparison, using CNF increased the retention to 73% even in the absence of retention aids. Combination of CNF and the microparticle further improved retention to 89%. Clearly, CNF has very positive effect on filler and fins retention, which brings additional benefits for papermaking.

TABLE 5

CNF improves first-pass retention and first-pass ash retention

| Furnish | Retention aid chemicals | FPR, % | FPAR, % |
|---|---|---|---|
| Pulp + 50% PCC + 14 kg starch | No | 54 | 18 |
| Pulp + 50% PCC + 14 kg starch | 0.5 kg CPAM + 0.3 kg S/0.3 kg MP | 74 | 53 |
| Pulp + (50% PCC + 5% CNF) + 14 kg starch | No | 84 | 73 |
| Pulp + (50% PCC + 5% CNF) + 14 kg starch | 0.5 kg CPAM + 0.3 kg S/0.3 kg MP | 93 | 89 |

Note:
1. Dosages in kilogram are based on one metric ton of whole furnish;
2. CPAM: cationic polyacrylamide; S: silica; MP: micropolymer.

Example 10

Cellulose nanofilaments were produced from a bleached softwood kraft pulp following the same procedure as in Example 2. The water retention value (WRV) of this CNF was determined to be 355 g of water per 100 g of CNF, while a conventional refined kraft pulp (75% hardwood/25% softwood) w/w had a WRV of only 125 g per 100 g of fibers. Thus CNF has very high water absorbency.

Example 11

Cellulose nanofilaments were produced from various pulp sources following the same procedure as in Example 2. A settlement test was conducted according to Weibel and Paul's procedure described earlier. Table 6 shows the consistency of CNF aqueous suspension at which the settlement volume equals to 50% v/v after 24 hours. The value for a commercial MFC is also listed for comparison. It is observed that the CNFs made according to the present invention had much lower consistency than the MFC sample to reach the same settled volume. This low consistency reflects the high aspect ratio of the CNF.

Table 6 also shows the shear viscosity of these samples determined at a consistency of 1% (units), 25° C. and a shear rate of 100 $s^{-1}$. The viscosity was measured with a stress-controlled rheometer (Haake RS100) having an open cup coaxial cylinder (Couette) geometry. Regardless of the source fibers, the CNFs of the present invention clearly had much higher viscosity than the MFC sample. This high viscosity μs caused by the high aspect ratio of CNF.

TABLE 6

Consistency resulting in 50% settled volume and viscosity of 1% w/w suspension of various CNF samples and a commercial MFC sample.

| Samples | Consistency resulting in 50% settled volume after 24 hrs (%) | Viscosity at a shear rate of 100 $s^{-1}$ of 1% w/w suspension with water (cP) |
|---|---|---|
| CNF from NBSK[1] market pulp | 0.018 | 127 |
| CNF from never-dried unbleached softwood kraft pulp | 0.016 | 144 |
| CNF from never-dried bleached softwood kraft pulp | 0.016 | 135 |
| CNF from bleached hardwood kraft market pulp[2] | 0.022 | 129 |
| A commercial MFC | 0.38 | 10.4 |

Note:
[1]North Bleached Softwood Kraft;
[2]The fines in the hardwood pulp had been removed before making CNF.

Figure 9:
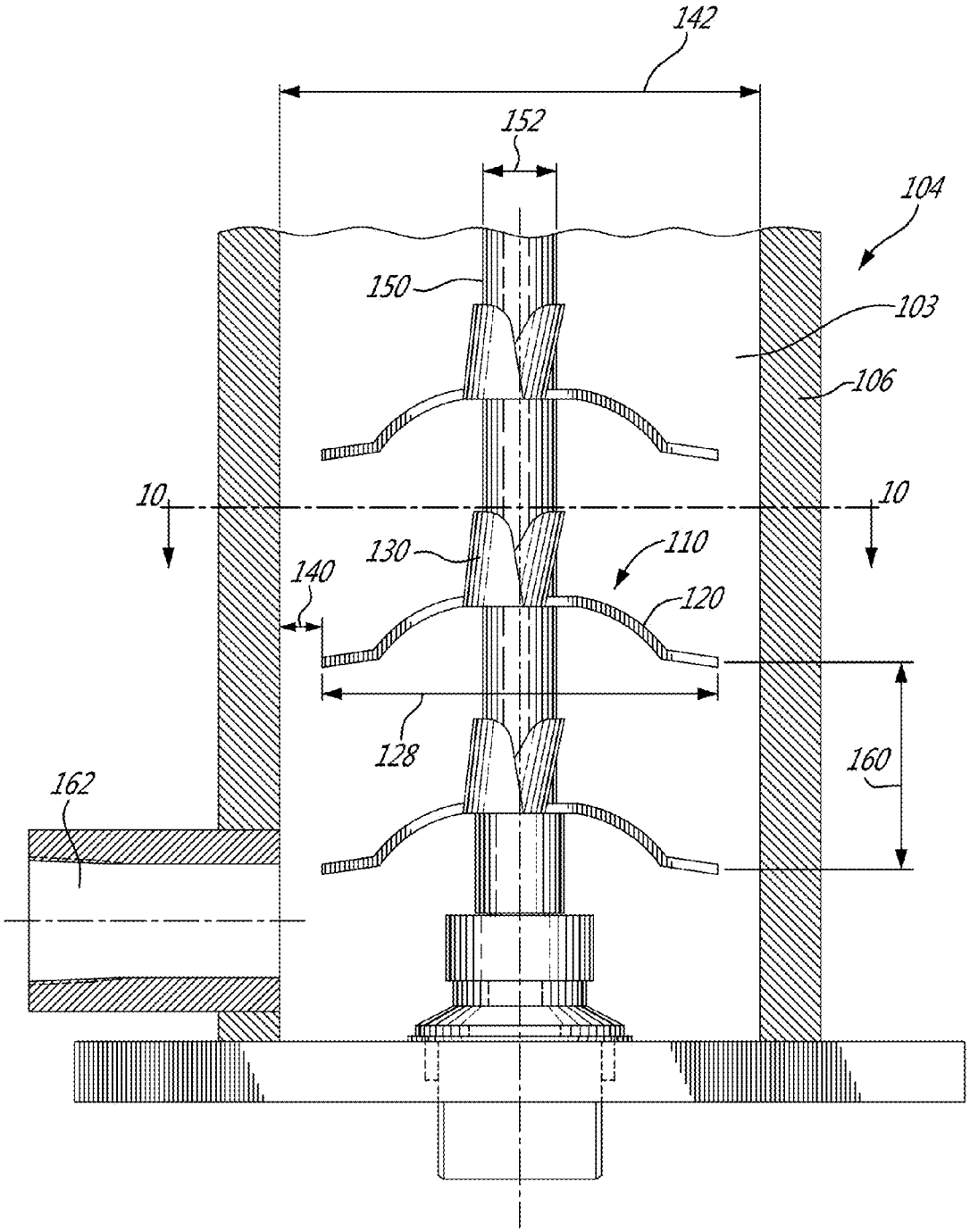
FIG. 9 illustrates a cross-section view of a nanofilamenting device according to one embodiment of the present invention.

FIG. 9 illustrates a nanofilamentation device or nanofilamenter 104 according to one embodiment of the present invention. The nanofilamenter 104 includes a vessel 106, with an inlet 102 and outlet (not illustrated but generally found a the top of the vessel 106). The vessel 106 defines a chamber 103 in which a shaft 150 is operatively connected to drive motor (not shown) typically through a coupling and a seal arrangement. The nanofilamenter 104 is designed to withstand the conditions for processing cellulosic pulp. In a preferred embodiment the vessel 106 is mounted on a horizontal base and oriented with the shaft 150 and axis of rotation of the shaft 150 in a vertical position. The inlet 102 for the raw material pulp is in a preferred embodiment found near the base of the vessel 106. The raw material cellulosic pulp is pumped upward towards the outlet (not illustrated). The residence time within the vessel 106 varies but is from 30 seconds to 15 minutes. The residence time depends on the pump flow rate into the nanofilamenter 104 and any recirculation rate required. In another preferred embodiment the vessel 106 can include an external cooling jacket (not illustrated) along the vessel full or partial length.

Figure 10:
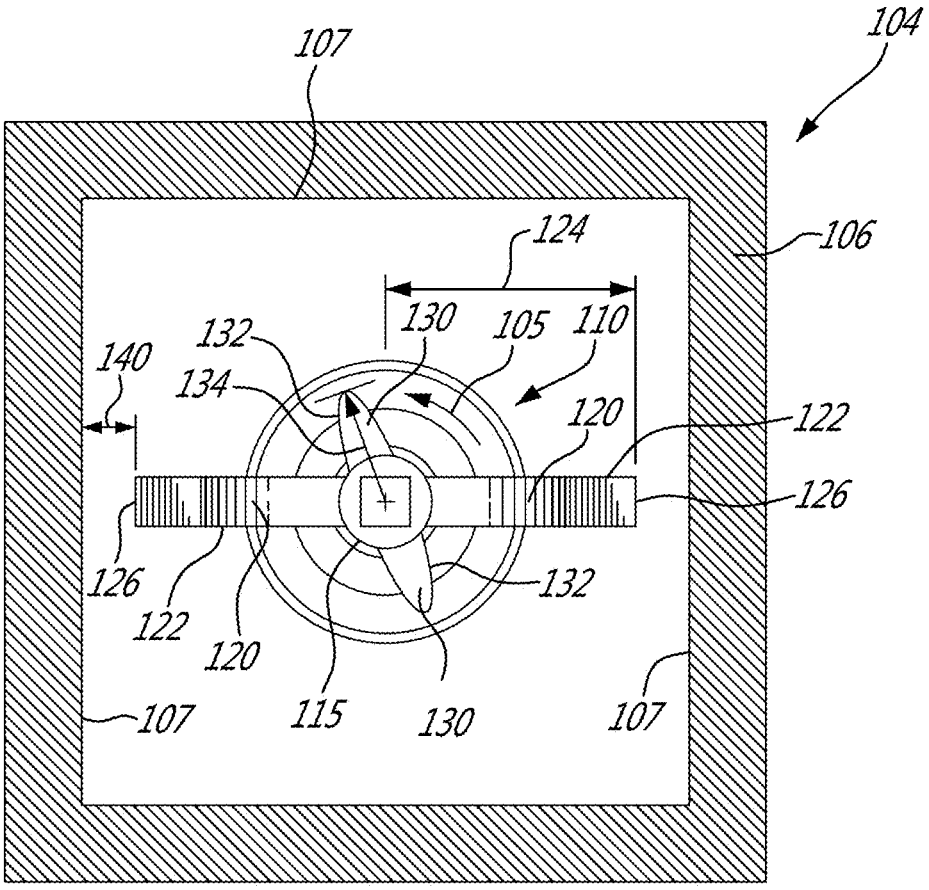
FIG. 10 illustrates a sectional taken along a cross-section lines 10-10 of FIG. 9, illustrating one embodiment of a peeling agitator including blades according to one embodiment of the present invention.

The vessel 106 and the chamber 103 that it defines may be cylindrical however in a preferred embodiment the shape may have a square cross-section (see FIG. 10). Other cross-sectional shapes may also be used such as: a circular, a triangle, a hexagon and an octagon.

The shaft 150 having a diameter 152 includes at least one peeling agitator 110 attached to the shaft 150. A plurality or multiple peeling agitators 110 are usually found along the shaft 150 where each agitator 110 is spaced apart from another, by a spacer typically having a constant length 160, that is in the order of half the diameter 128 of the agitator 110 or so. Clearly each blade 120, 130 has a radius 124 and 134 respectively. The shaft rotates at high speeds up to (about 20,000 rpm), with an average linear speed of at least 1000 m/min at the tip 128 of the lower blade 120.

The peeling agitator 110 (as seen in FIG. 10) in a preferred embodiment includes at least four blades (120,130) extending from the center hub 115 that is mounted on or attached to the rotating shaft 150. In a preferred embodiment a set of two smaller blades 130 project upward along the axis of rotation, and another set of two blades 120 are oriented downward along the axis. The diameter of the top two blades 130 is in a preferred embodiment from 5 to 10 cm, and in a particularly preferred case is 7.62 cm (from the tip to the centre of the shaft). If viewed in cross-section (as illustrated in FIG. 10) the radius 132 of blades 130 varies from 2 to 4 cm in the horizontal plane. The lower blade set 120 may have a diameter varying from 6 to 12 cm, with 8.38 cm being preferred in a laboratory installation. The width of the blade 120 is generally not uniform, it will be wider at the centre and narrower at the tip 126, and roughly 0.75 to 1.5 cm at the central portion of the blade, with a preferred width at the center of the blade 120 of about 1 centimeter. Each set of two blades has a leading edge (122, 132) that has a sharp knife edge moving in the direction of the rotation of the shaft 105.

Different orientations of the blades on the agitator are possible, where blades 120 are below the horizontal plate of the center hub and blades 130 are above the plate. Furthermore, blades 120 and 130 may have one blade above and the other below the plate.

The nanofilamenter 104 includes a gap 140 spacing between the tip 126 of blade 120 and inner surface wall 107. This gap 140 is typically in the range of 0.9 and 1.3 cm to the nearest vessel wall where the gap is much greater than the final length of the nanofilament obtained. This dimension holds also for bottom and top agitator 110 respectively. The gap between blades 130 and the inner surface wall 107 is similar to or slightly larger than that between the blade 120 and the wall surface 107.

The invention claimed is:

1. Cellulosic nanofilaments, wherein the nanofilaments are natural wood or plant fibers, the nanofilaments comprising:

a ratio of $DP_{nanofilaments}/DP_{initial}$ is at least 0.75, wherein $DP_{nanofilaments}$ is a degree of polymerization of the cellulosic nanofilaments and $DP_{initial}$ is an initial degree of polymerization of a source natural wood or plant fibers, the nanofilaments further comprising a length of at least 100 μm, and a width of about 30 to about 300 nm, wherein the nanofilaments are physically detached from each other, and are substantially free of fibrillated cellulose, wherein the nanofilaments have an apparent freeness value of over 700 ml according to Paptac Standard Testing Method C1, and, wherein a suspension comprising 1% w/w nanofilaments in water at 25° C. under a shear rate of $100s^{-1}$ has a viscosity greater than 100 cps.

2. The nanofilaments according to claim 1, wherein an aqueous suspension of over 0.1% w/w fails to settle according to a settling test described in GB 2 296 726.

3. The nanofilaments according to claim 1, wherein an aqueous suspension of less than 0.05% w/w settles to 50% volume according to the settling test described in GB 2 296 726.

4. The nanofilaments according to claim 1, wherein the length is between 100 μm and 500 μm.

5. The nanofilaments according to claim 1, comprising a surface charge of at least 60meq/kg.

6. The nanofilaments according to claim 1, wherein the ratio of $DP_{nanofilament}/DP_{initial}$ is at least 0.80.

7. A mineral paper comprising at least 50% by weight of mineral filler and at least 1%, and up to 50% cellulose nanofilaments according to claim 1.

8. The paper according to claim 7, having mineral content up to 90%.

* * * * *